US005481983A

United States Patent [19]

Guzman et al.

[11] Patent Number: 5,481,983

[45] Date of Patent: Jan. 9, 1996

[54] MAGNETIC SWEEPER APPARATUS AND METHOD

[75] Inventors: Alberto M. Guzman; Hodge E. Jenkins, III, both of Pittsburgh, Pa.; Ronald R. Newman, Arlington, Tex.; Suryanarayan G. Sankar, Upper St. Clair; John G. Tabacchi, Oakmont, both of Pa.

[73] Assignee: Burlington Northern Railroad Company, Fort Worth, Tex.

[21] Appl. No.: 330,351

[22] Filed: Oct. 27, 1994

Related U.S. Application Data

[63] Continuation-in-part of Ser. No. 56,131, Apr. 30, 1993, abandoned.

[51] Int. Cl.[6] ..... B61F 19/06

[52] U.S. Cl. ..... 104/279; 209/215; 209/223.1

[58] Field of Search ..... 105/238.1; 104/279; 280/757, 855, 856; 209/215, 218, 223.1

[56] References Cited

U.S. PATENT DOCUMENTS

| | | | |
|---|---|---|---|
| 604,867 | 5/1898 | Le Van | 105/352 |
| 1,114,997 | 10/1914 | Lieb | 248/235 |
| 1,224,016 | 4/1917 | Petersen | 248/235 |
| 1,726,158 | 8/1929 | Masbury et al. | 280/160 |
| 1,745,970 | 2/1930 | Andrew | 209/215 |
| 2,605,119 | 7/1952 | Earnest | 280/160 |
| 2,629,495 | 2/1953 | Smale | 209/223.1 |
| 2,660,454 | 11/1953 | Coumerilh | 280/163 |
| 2,818,176 | 12/1957 | Polich | 209/215 |
| 3,249,211 | 5/1966 | Gray | 198/229 |
| 3,401,365 | 9/1968 | Grader et al. | 104/279 |
| 3,489,280 | 1/1970 | Israelson et al. | 209/223.1 |
| 3,698,680 | 10/1972 | Shoemaker | 249/189 |
| 3,709,360 | 1/1973 | Baker | 209/215 |
| 3,956,111 | 5/1976 | Manfredi | 209/215 |
| 4,214,984 | 7/1980 | MacElvain | 209/223.1 |
| 4,225,429 | 9/1980 | Holley | 209/215 |
| 4,478,152 | 10/1984 | Holley | 104/279 |
| 4,541,661 | 9/1985 | Hawk | 293/117 |
| 4,709,529 | 12/1987 | Matsuda et al. | 198/936.1 |
| 4,903,856 | 2/1990 | Watts | 280/160 |

*Primary Examiner*—Robert J. Oberleitner
*Assistant Examiner*—S. Joseph Morano
*Attorney, Agent, or Firm*—Robert A. Felsman

[57] ABSTRACT

A magnetic sweeper 20 is disclosed for capturing airborne particles which exhibit ferromagnetic behavior. The magnetic sweeper 20 uses a magnet(s) 43 having a magnetic field strength which captures particles coming within a predetermined distance of the magnet 43. A non-magnetic endless belt 31 is arranged about the magnet 43, wherein the particles are impinged against the belt 31 by the magnetic field lines of flux. This area is defined as a particle capturing first station. The belt 31 moves the captured particles further away from the magnet 43 to a second station. Located at the second station is a collector which includes a vacuum, a brush 41 and a particle flange. As will be appreciated by those skilled in the art, the magnetic field strength diminishes with distance from the magnet 43. Accordingly, after a certain distance from the magnet 43, the field strength drops to a point where the particles fall from the belt 31. When the particles are released, the particles are entrained in a vacuum and transported to a storage location 32 using the vacuum. A preferred location for the magnetic sweeper 20 is under the rear coupler 21 of a locomotive 25.

26 Claims, 6 Drawing Sheets

FIG. 7a
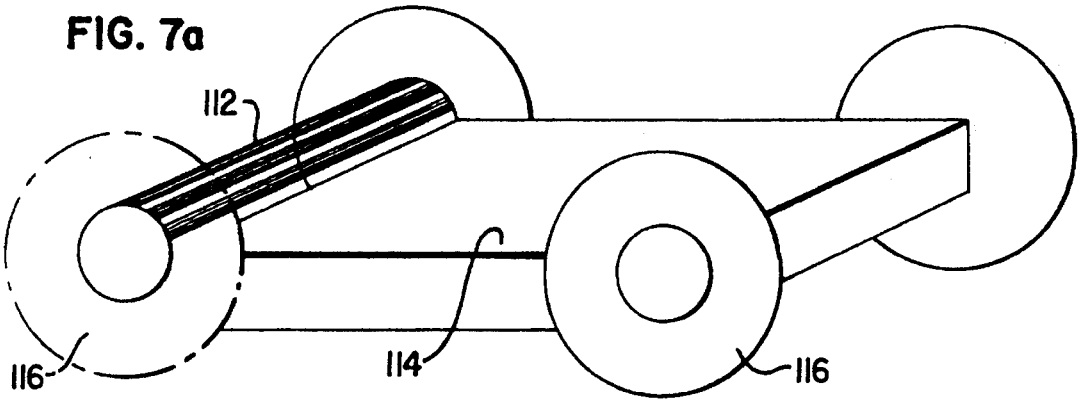
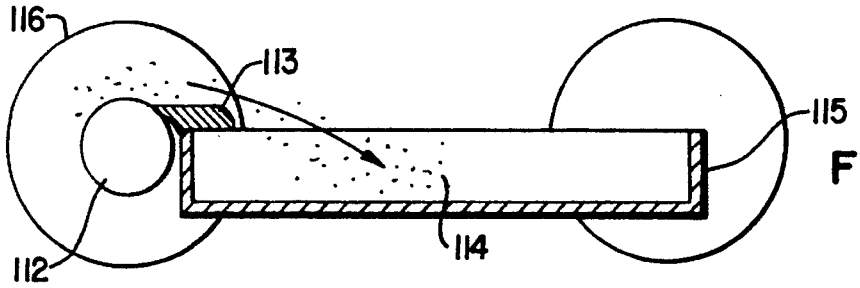
FIG. 7b
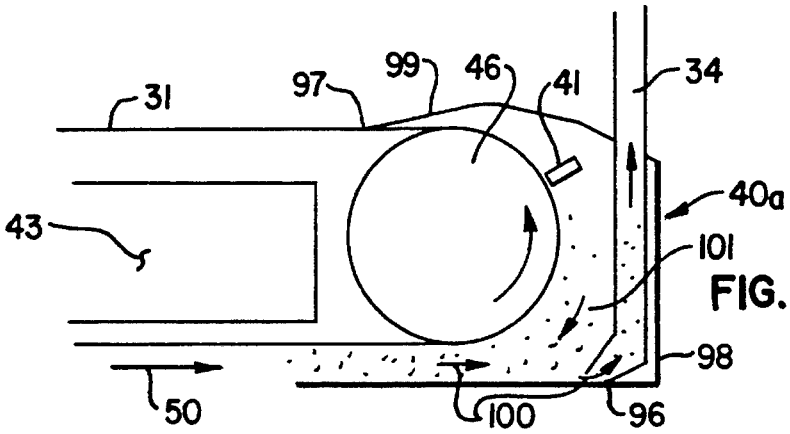
FIG. 5
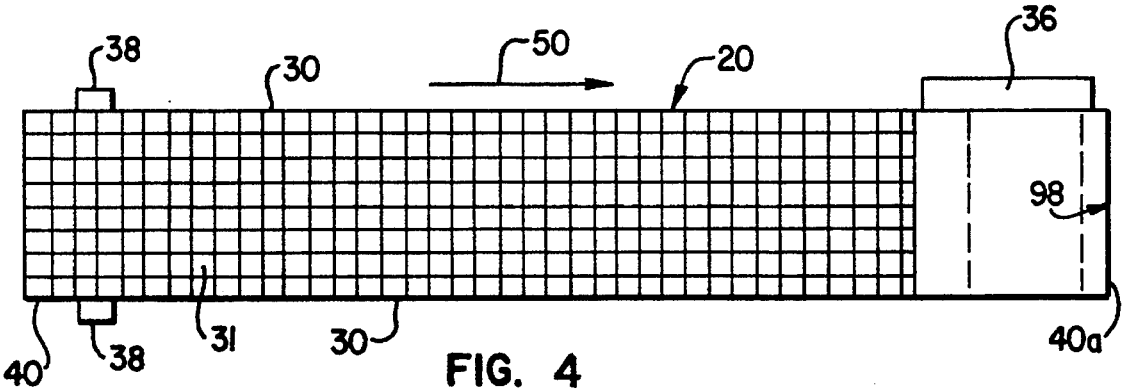
FIG. 4

MAGNETIC SWEEPER APPARATUS AND METHOD

CROSS-REFERENCE TO RELATED APPLICATIONS

This application is a continuation-in-part of U.S. patent application Ser. No. 08/056,131, filed on Apr. 30, 1993 by Guzman et al now abandoned.

FIELD OF THE INVENTION

The invention relates generally to a device for attracting and collecting objects in and around a railroad bed. More specifically, the invention relates to a magnetic sweeper apparatus which attracts and collects airborne metallic particles, which exhibit ferromagnetic behavior, over a railroad bed during transit along the railroad bed.

BACKGROUND OF THE INVENTION

When disassembling a rail for replacement, various small metallic articles (e.g., spikes, tie plates, and anchors) are removed and laid upon the railroad bed. Since it is desirable to clear the railroad bed of such metallic articles and re-use such articles to the extent possible, several magnetic wheel-type devices for picking up these metallic articles have been previously developed. For example, U.S. Pat. Nos. 4,478,152 and 4,225,429 disclose railroad scrap pick-up machines having a magnetic wheel device that is useable with a specially designed rail-mounted vehicle. The disclosed devices pick up scrap articles such as tie plates and rail spikes lying on the railroad bed.

Smaller metallic filings of iron are also found along rail beds. Such iron filings are generally produced by rail grinder trains which are employed on railroads to grind the top surface of the rail in order to extend rail life. Other sources of metallic particles include wear debris, such as wheel to rail contact (especially in curve negotiation), brake shoe dust, ore droppings from transport, etc.

When a train travels along the rail bed, these small iron filings (or other metallic particles) may become airborne due to the strong air currents generated by the movement of the engine and railcars over the track. Once airborne, the particles may be blown into the railcars. This particle contamination can create problems with certain types of freight as will next be described.

New motor vehicles (such as cars, light trucks, vans, etc.), as well as a variety of other goods, are commonly transported on railroad cars from manufacturing plants to various destinations. Motor vehicles are usually transported in multi-level auto rack railroad freight cars. These multi-level rail cars usually have openings and gaps in their side wall screens and end doors which permit entrance of contaminants such as fine metallic particles and/or dust particles coming off the railroad bed during transit. Under the right conditions of temperature, air current speed, and humidity, these contaminants become airborne from the railroad bed, settle on the transported motor vehicles and then bloom into rust. The main areas of rust concern tends to be the horizontal painted surfaces of the motor vehicles being transported. This rust damage can even occur on the transported motor vehicles after the vehicles have been deramped and set out on lots awaiting distribution. This problem has existed for many years and motor vehicle manufacturers who ship on the railroad lines want to prevent this problem.

However, the increased activity of rail grinding by railroad companies has served to aggravate this problem.

To date, solutions to eliminate the problem of contamination from airborne particles have been expensive and impractical. For example, one proposed solution is to wash the automobiles before the particles have become anchored to the paint as a result of the rusting process. A second proposed solution was based on tests indicating that air flows inside typical auto racks occurs with the air entering the side screens (in the middle of the car), migrating to both ends of the car, and being expelled near the end doors. Therefore, to alleviate this problem, prototypes have been built with solid side screens. The solid side screens noticeably reduce air flow inside the auto rack. The reduced airflow reduces the amount of dust contamination, and also causes particles to "fall out" or "settle out" of the air flow before reaching auto paint surfaces. However, it is believed that completely sealing the rail car may lead to toxic fume problems for auto loaders and unloaders.

Therefore, there is a need to minimize the high cost of either pre-treating autos with coatings or repairing damage at the auto's destination by reducing or completely eliminating the amount of metallic particles entering auto rack rail cars. In particular, it would be considered beneficial to minimize the amount of magnetic iron/iron oxide particles entering auto rack rail cars, or other particles which create rust problems on automobiles carried as freight. More generally, there is a need for minimizing the intrusion of contaminants (such as metallic grit and dust particles) into a rail car to prevent or reduce damage to motor vehicles and other goods being transported. The present invention helps to alleviate the above contamination problem as discussed in greater detail below.

SUMMARY OF THE INVENTION

The present invention provides for a magnetic particle sweeper apparatus and method that overcomes the foregoing and other difficulties associated with the prior art. In accordance with the principles of the invention, there is provided a magnetic sweeper which when transported over a rail bed is useful for reducing metallic airborne particles -such as the type which can settle on goods being transported by railroad cars.

In a preferred embodiment, the magnetic sweeper captures airborne ferrous particles by using a magnet(s) having a magnetic field strength which captures particles coming within a predetermined distance of the magnet. A non-magnetic endless belt is arranged about the magnet, wherein the particles are impinged against the belt by the magnetic field lines of flux. This area is defined as a particle capturing first station. The belt moves the captured particles further away from the magnet to a second station. Located at the second station is a collection means comprising a vacuum means, a brush and a particle flange. As will be appreciated by those skilled in the art, the magnetic field strength diminishes with distance from the magnet. Accordingly, after a certain distance from the magnet, the field strength drops to a point where the particles fall from the belt. When the particles are released, the particles are entrained in a vacuum and transported to a storage location using the vacuum.

A preferred location for the magnetic sweeper is under the rear coupler of the locomotive. In the preferred position it is located a minimum distance above the rail. It will be appreciated, however, that the magnetic sweeper may be located at other areas of both freight cars and locomotives as well. The preferred magnetic sweeper's size, the size of the required magnet(s) and other constraints make it too costly and impractical to lift particles from the rail bed using magnetic force alone. Therefore, the preferred magnetic sweeper is configured to attract airborne particles as they pass in the proximity of the sweeper.

One feature of the present invention is that only the contaminants which are of interest are collected. In the present case metallic/ferrous particles are of concern in view of the destructive rust tendency which these particles exhibit on painted surfaces. The grinding action on the rails, described above, typically produces a large amount of particles—on the order of ½ to 1 ton per mile of track length. Therefore, it is virtually impossible to clean the entire particulate matter from the rail bed. However, the vast majority of the particles do not affect the passage of goods over the rail line. The particles which do affect the goods are those which become airborne from the air currents generated by the passage of the train over the tracks (or other wind currents). Accordingly, the present invention is mainly limited to attracting those airborne particles. Those skilled in the art will appreciate, however, that certain other particles (e.g., of a certain size) which are not airborne may also be attracted to the sweeper. In one preferred embodiment of the invention, a large particle filter may be included to prevent larger particles from becoming lodged in the sweeper.

Another advantage of the present invention is that its size allows it to be located underneath the coupler of the locomotive (or other rail car) to take advantage of the air currents generated by the train. By using the aerodynamic lifting force generated by the train, this also reduces the amount of energy which must be generated by the sweeper. Portions of the sweeper may be located inside a rail car and/or a weatherproofed container for protection from the environment.

Yet another advantage of the present invention is that the particles collected by the sweeper are contained via a vacuum system into a storage container. Thus, the particles do not have an opportunity to become airborne once again.

Therefore, according to one aspect of the invention, there is provided a magnetic particle sweeper apparatus for railroad beds, of the type which collects airborne particles exhibiting ferromagnetic behavior, comprising: (a) a support frame; (b) first and second rollers located at opposite ends of said frame; (c) a continuous driven belt passing over said first and second rollers; (d) magnetic means operatively connected to said frame and located within said belt, wherein airborne particles are attracted to said magnetic means and are impinged on said belt; and (e) particle collection means, cooperatively connected to said second end of said frame, for collecting the particles to minimize allowing the impinged particles from becoming airborne, wherein subsequent to the particles being transported along a portion of said belt and away from said magnetic means said collection means transports the particles to a remote location, and wherein said particle collection means includes: (i) a particle flange which is arranged and configured at said second end of said frame; and (ii) a vacuum source operatively inserted through said particle flange and which tends to draw the particles from said second end.

In accordance with another aspect of the invention, there is provided a magnetic sweeper apparatus for use on a railroad car for collecting airborne metallic particles and grit from a railroad bed, comprising: (a) a supporting frame structure which can be attached to an underside of the railroad car, wherein at least one side of said supporting frame structure forms a channel having two oppositely disposed side walls and a bottom; (b) a source of magnetic attraction operatively attached to said supporting frame structure, the area of magnetic attraction defining a first location; (c) a prime mover operatively attached to said supporting frame structure; (d) a nonmagnetic endless belt driven by said prime mover, said belt arranged and configured with said supporting frame member so as to nearly completely encompass said source of magnetic attraction, and to extend outside of said source of magnetic attraction in at least a second location, wherein said belt is located at the bottom of said channel; and (e) particle collection means, operatively connected to said supporting frame member at said second location, wherein said particle collection means includes: (i) a particle flange which is arranged and configured at said second end of said frame; (ii) a vacuum source operatively inserted through said particle flange and which tends to draw the particles from said second end at an inlet nozzle; (iii) a brush in operative contact with said belt for removing particles from said belt which do not release from said belt by gravity once the particles are outside of the magnetic field of said magnet means; and (iv) a sealing gasket hingedly attached at a first end to said particle flange and arranged and configured to fit within said side walls of said channel, wherein said sealing gasket includes a second end which slidingly engages said belt, and wherein a seal is created at said one side of said supporting frame, whereby air flow is directed to said inlet nozzle from proximate said second location, wherein airborne particles are attracted to said source of magnetic attraction at said first location of said belt and are transported to said second location where the particles are collected by said particle collection means to minimize the particles which are airborne, and wherein said source of magnetic attraction attracts and collects particles and grit exhibiting ferromagnetic behavior which are raised from the railroad bed during travel of the railroad car thereby protecting transported products.

According to a further aspect of the invention, there is provided a magnetic device for use on a railroad car to capture airborne magnetic particles, the combination comprising: (a) a railroad car having a coupler device; (b) at least one magnetic sweeper device attached to said coupler device, said magnetic sweeper device including: i) a support frame comprising two oppositely disposed elongated members with cross braces, wherein said elongated members are oriented transversely with respect to the longitudinal axis of the direction of travel of said railroad car; ii) a first and second roller member located at opposite ends of said frame; iii) a continuous driven belt passing over said first and second rollers; iv) magnetic means operatively connected to said frame and located within said belt, wherein particles are attracted to said magnetic means and are impinged on said belt; v) particle collection means, cooperatively connected to said second end of said frame, for collecting said particles to minimize allowing the impinged particles from becoming airborne, wherein subsequent to the particles being transported along the length of said belt and away from said magnetic means, said collection means transports the particles to a remote location.

According to another aspect of the invention, there is provided a method of attracting and collecting airborne metallic particles and grit from a railroad bed during travel of a railroad car, comprising the steps of: (a) driving a continuous belt over rollers within a support frame; (b) orienting the longitudinal axis of said belt generally perpendicular to the longitudinal axis of the rails; (c) attracting airborne particles which are lifted from a railroad bed by the aerodynamic action of a passing railroad car, with magnetic means operatively connected to said frame and located within said belt, whereby particles are attracted to said magnetic means and are impinged on said belt; and (d) collecting said particles to minimize allowing the impinged particles from becoming airborne, wherein subsequent to the particles being transported along the length of said belt and away from said magnetic means, said collection means transports the particles to a remote location.

In accordance with a further aspect of the invention, there is provided a magnetic particle sweeper apparatus for collecting airborne particles exhibiting ferromagnetic behavior from a railroad bed during transportation of a railroad car, comprising: (a) a support frame adapted for mounting on a railroad car; (b) first and second rollers located at opposite ends of said frame; (c) a continuous driven belt passing over said first and second rollers and having a longitudinal axis oriented generally transverse to a direction of travel of the railroad car; (d) magnetic means operatively connected to said frame and located within said belt, wherein airborne particles are attracted to said magnetic means and are impinged on said belt; and (e) particle collection means, cooperatively connected to said second end of said frame, for collecting said particles to minimize allowing the impinged particles from becoming airborne, wherein subsequent to the particles being transported along a portion of said belt and away from said magnetic means said collection means transports the particles to a remote location.

In accordance with yet another aspect of the invention, there is provided a magnetic particle sweeper apparatus for railroad beds, of the type which collect airborne particles exhibiting ferromagnetic behavior, comprising: (a) a support frame; (b) first and second rollers located at opposite ends of said frame; (c) a continuous driven belt passing over said first and second rollers; (d) magnetic means operatively connected to said frame and located within said belt, wherein airborne particles are attracted to said magnetic means and are impinged on said belt; (e) particle collection means, cooperatively connected to said second end of said frame, for collecting said particles to minimize allowing the impinged particles from becoming airborne, wherein subsequent to the particles being transported along a portion of said belt and away from said magnetic means said collection means transports the particles to a remote location; and (f) large particle filtering means, coupled to said frame, for preventing particles larger than a predetermined size from impinging on said belt.

According to an additional aspect of the invention, there is provided a railroad locomotive, comprising: (a) a coupler device; (b) at least one magnetic sweeper device attached to said coupler device for capturing airborne magnetic particles, said magnetic sweeper device including: i) a support frame comprising two oppositely disposed elongated members joined by cross braces and oriented transversely with respect to the longitudinal axis of the direction of travel of said locomotive; ii) first and second roller members located at opposite ends of said frame; iii) a continuous driven belt passing over said first and second rollers; iv) magnetic means operatively connected to said frame and located within said belt, wherein particles are attracted to said magnetic means and are impinged on said belt; and v) particle collection means, cooperatively connected to said second end of said frame, for collecting said particles to minimize allowing the impinged particles from becoming airborne, wherein subsequent to the particles being transported along the length of said belt and away from said magnetic means, said collection means transports the particles to a remote location.

These and other advantages and features which characterize the present invention are pointed out with particularity in the claims annexed hereto and forming a further part hereof. However, for a better understanding of the invention, its advantages and objects attained by its use, reference should be made to the drawing which forms a further part hereof and to the accompanying descriptive matter, in which there is illustrated and described a preferred embodiment of the present invention.

BRIEF DESCRIPTION OF THE INVENTION

In the drawing, which forms a part of the instant specification and are to be read therewith, embodiments of the invention are shown. Like numerals are employed in the various views to indicate like parts.

FIG. 4 is a bottom view of the preferred embodiment magnetic sweeper 20 of FIG. 1 with portions shown in phantom;

Figure 1:
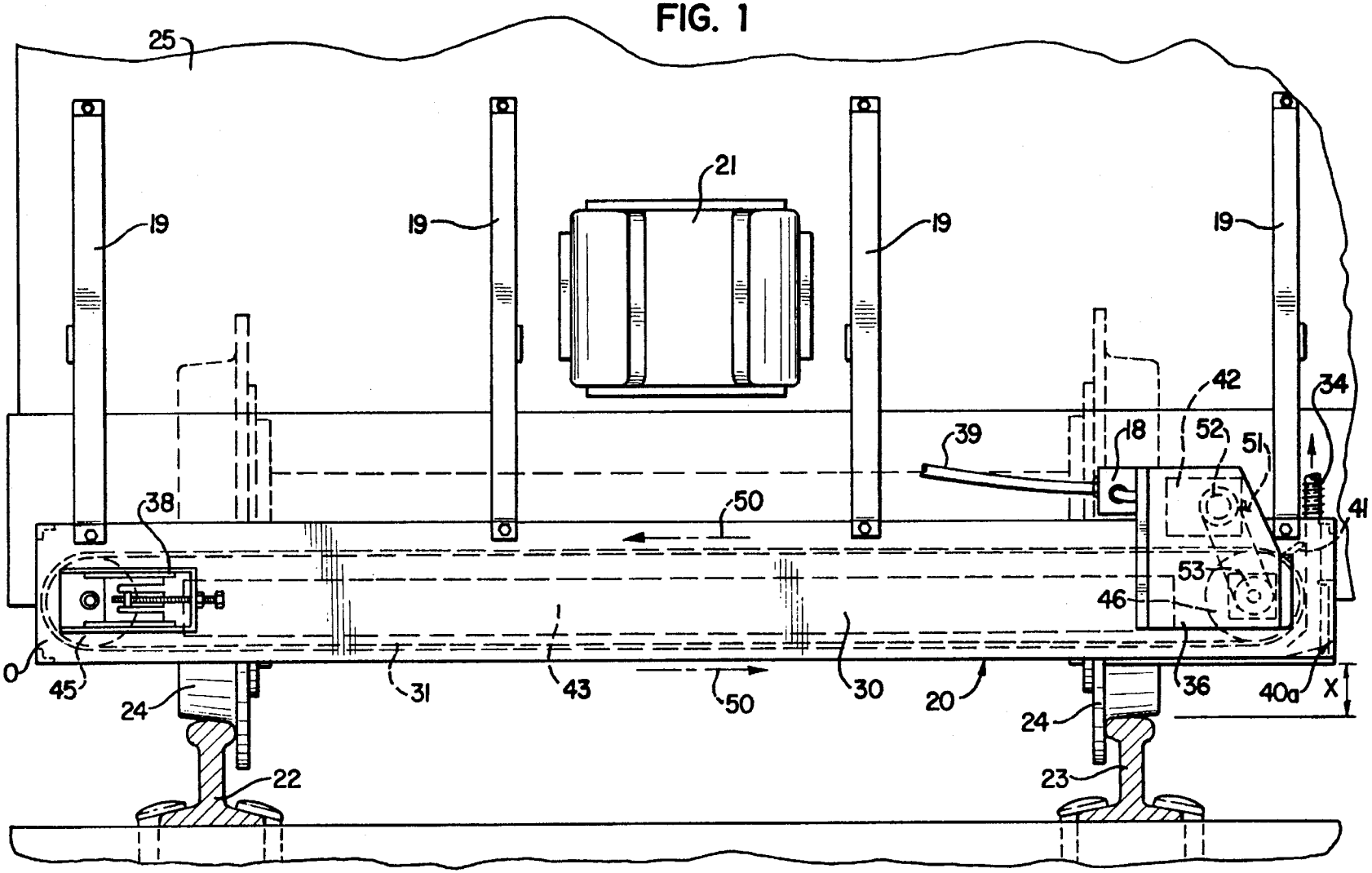
FIG. 1 is a front view of a preferred embodiment magnetic sweeper 20 constructed in accordance with the principles of the present invention, with portions shown in phantom and in an operative environment.
Figure 9:
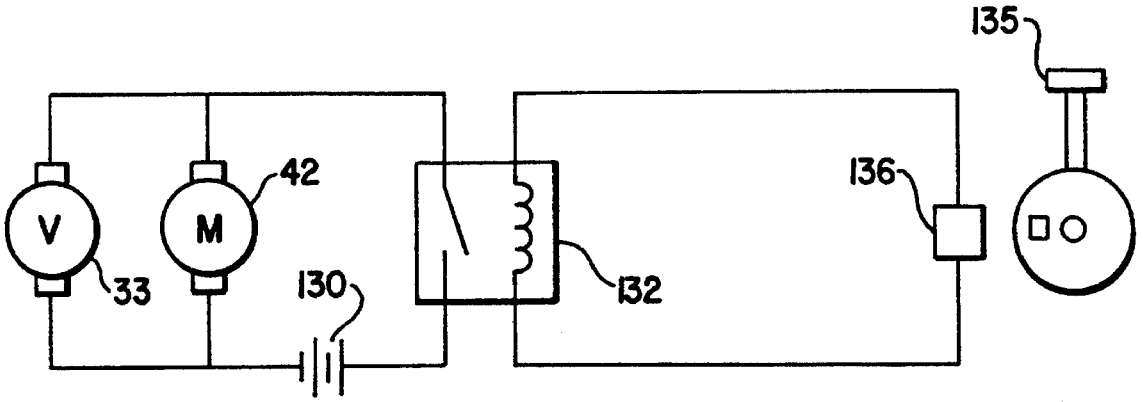
Figure 6A:
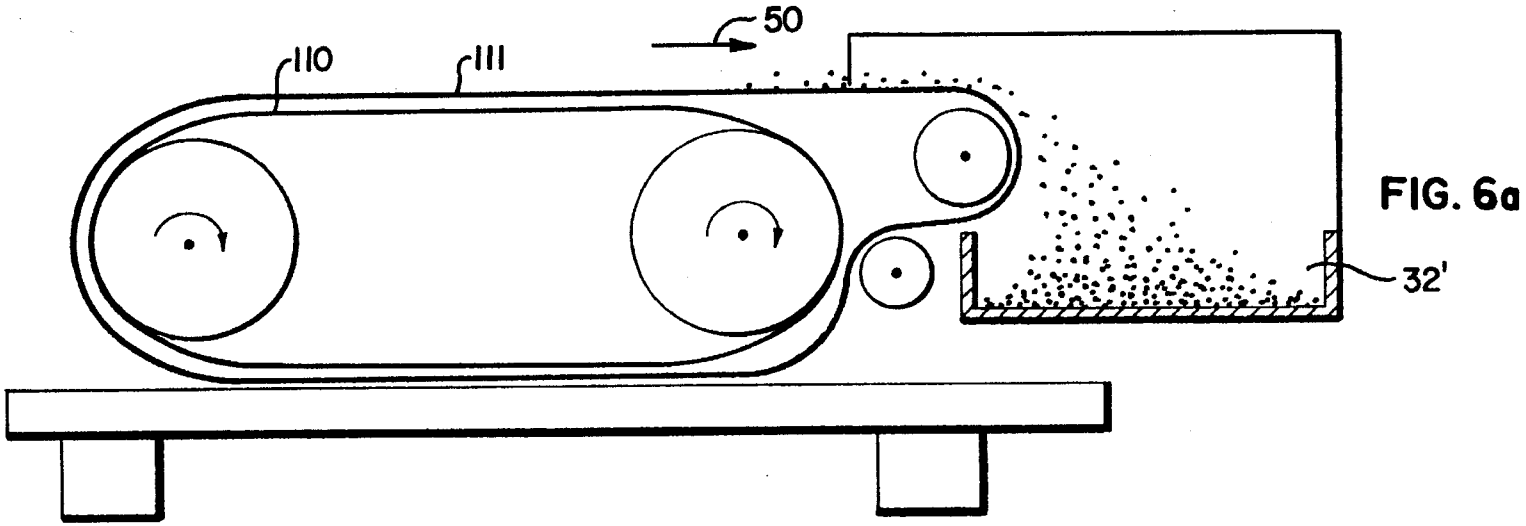
Figure 6B:
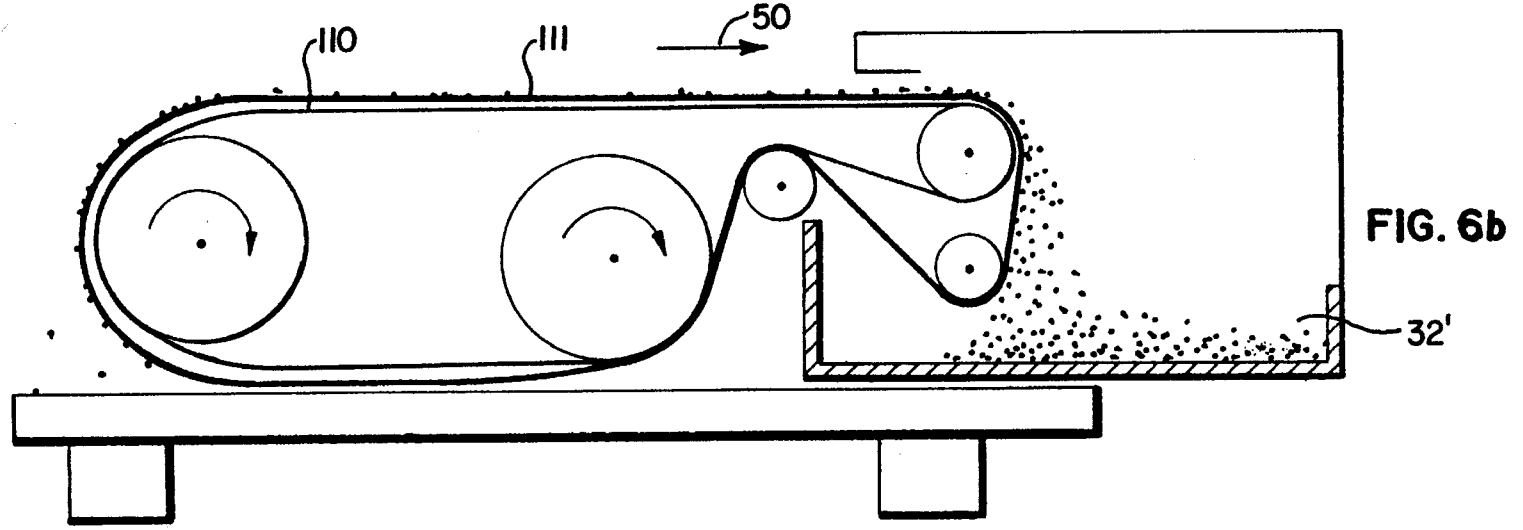
Figure 8:
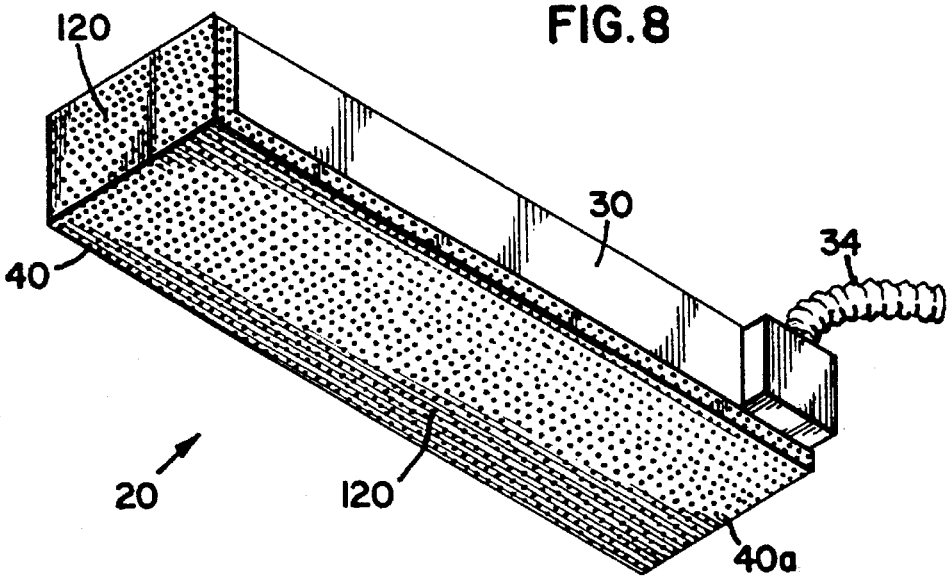
Figure 10:
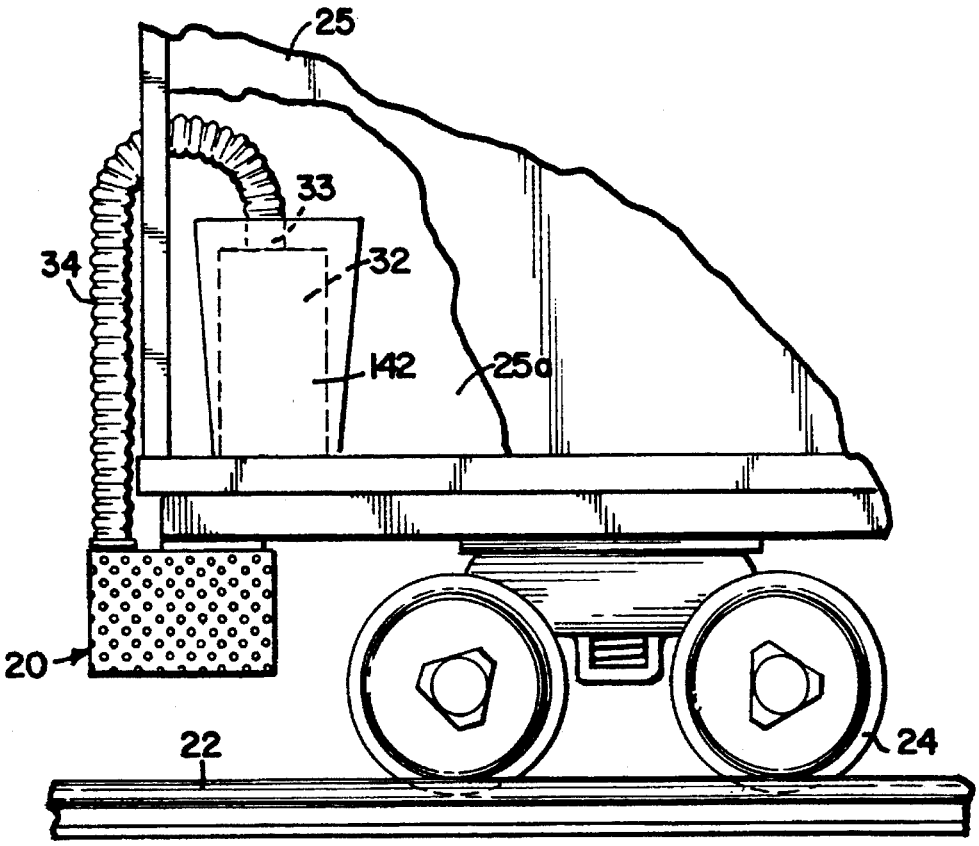

FIG. 5 diagrammatically illustrates the operation of the magnetic sweeper of the present invention;

FIGS. 6*a* and 6*b* illustrate alternative embodiment magnetic sweepers which utilize both a magnetic and a non-magnetic belt in combination, and each of which employs gravity collection;

FIGS. 7*a* and 7*b* illustrate alternative embodiment magnetic sweepers which utilize magnetic drums;

FIG. 8 is a lower perspective view of the magnetic sweeper 20 of FIG. 1 which utilizes an optional large particle filter for preventing the collection of large particles in the apparatus;

FIG. 9 is a functional schematic diagram of a cut off system for controlling the magnetic sweeper 20 of FIG. 1; and FIG. 10 is a perspective view of a locomotive showing an alternate placement of the magnetic sweeper 20 of FIG. 1.

DETAILED DESCRIPTION OF THE INVENTION

The principles of this invention apply particularly well to the capture of ferrous or metallic particles which become airborne due to air currents along a railroad bed. A preferred application for this invention is in connection with a train traveling along the railroad bed. Such application, however, is typical of only one of the innumerable types of applications in which the principles of the present invention can be employed.

The invention is particularly directed to a magnetic particle sweeper apparatus and method which may be used on a locomotive (or other railroad car) for attracting and collecting metallic particles and grit from a railroad bed during transit over the railroad bed. The magnetic sweeper is preferably used in connection with multi-level auto rack railroad freight cars which transport new automobiles and other motor vehicles to prevent contamination from metallic particles.

Fine metallic particles or grit, such as iron filings, are present from various sources in and around the railroad bed. The particles can come off the railroad bed during transit of the rail car, and can enter the rail car. Particles which settle on transported motor vehicles can cause rust damage on the vehicles, and particularly on the horizontal painted surfaces. The magnetic sweeper of the present invention attracts and collects such metallic particles. Thus, by utilizing the magnetic sweeper on a rail car, the intrusion of metallic particles is reduced, helping to prevent such particles from damaging motor vehicles transported on the rail car.

It should be appreciated that the drawings depict various preferred embodiments of the invention which can be formed in a variety of ways. While the description will proceed with respect to such drawings, it will be readily understood by those skilled in the art that such description and drawings are used to explain the novel features of this invention, rather than in any limiting sense.

Referring now to the Figs., there is illustrated preferred embodiments of a magnetic sweeper configured in accordance with the principles of the present invention. Referring first to FIG. 1, there is shown a magnetic sweeper 20 located beneath coupler 21 of locomotive 25. As previously noted, other locations of the magnetic sweeper 20 are possible and include freight cars, dedicated service vehicles, and tenders.

The advantages of employing the magnetic sweeper 20 beneath the coupler of locomotive 25 are that once mounted, it can reside there without further consideration vis-a-vis the order of the other cars. For example, if the sweeper 20 is mounted to a freight car it would be advantageous to locate the car near the front of the train so as to collect a maximum amount of particles prior to possible contamination of the freight. However, this requires further effort to ensure the location of a particular freight car. Additionally, the initial passing of the locomotive over the railroad bed may stir up the particles in a somewhat known manner and prior to the particles being caught in the eddy currents surrounding the train.

The magnetic sweeper 20 may also be mounted to a service vehicle or a tender car. However, such options are also considered less desirable. Utilizing the magnetic sweeper 20 on a separate tender car is undesirable because of the cost and logistics of making up the train. Also, the magnetic sweeper and its containment means (described below) require power which is not available on a tender car. The service vehicle is undesirable because of the cost of having a dedicated crew and piece of equipment.

Still referring to FIG. 1, magnetic sweeper 20 resides behind the wheels 24 of the locomotive 25, while the longitudinal axis of magnetic sweeper 20 is generally perpendicular to the rails 22, 23. Therefore, the longitudinal axis of belt 31 (best seen in FIG. 4) also operates generally perpendicular to the direction of the rails 22, 23°. Beneath the coupler 21 of the locomotive 25, a 1 foot×17 inch cross section area is available. In view of railway line clearances and safety considerations, the current maximum width of the magnetic sweeper 20 is seven (7) feet, four (4) inches at 2¾ inches above the rails 22, 23. The designation "X" illustrated in FIG. 1 indicates the clearance above the rails 22, 23. It is currently specified that the minimum clearance distance is between 2 and ½ inches and 3 inches. It will be appreciated that the orientation of the magnetic sweeper 20 with respect to the rails 22, 23 may be adjusted.

The magnetic sweeper 20 may be supported from the rear of the locomotive 25 structure (or other railway car structure) by appropriately sized and configured brackets 19, weldments (not shown) or other well known means.

Figure 3:
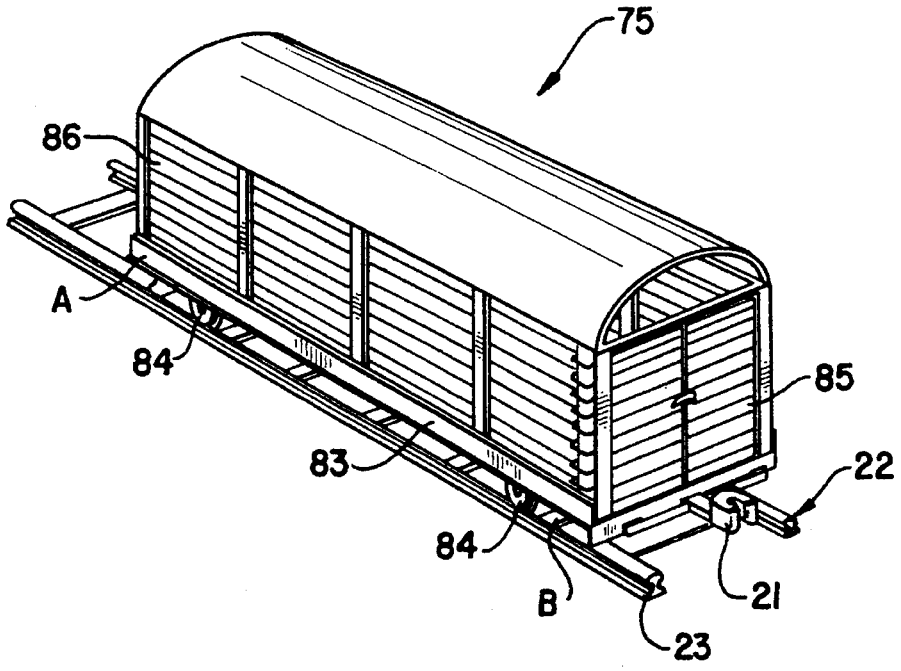
FIG. 3 is a perspective view of a rail car of the type in which motor vehicles are transported, and wherein the magnetic sweeper 20 of FIG. 1 may optionally be located.

Next referring to FIG. 3, a conventional multi-level auto rack freight rail car 75 having a first end A and a second end B is shown. Rail car 75 includes wheel trucks 84 attached to the underside of deck 83. Rail car 75 also includes end doors 85 and side wall screens 86. The magnetic sweeper 20 may optionally be attached at ends A or B, beneath deck 83 between the wheel trucks 84, or attached to the underside of coupler 21.

Figure 2:
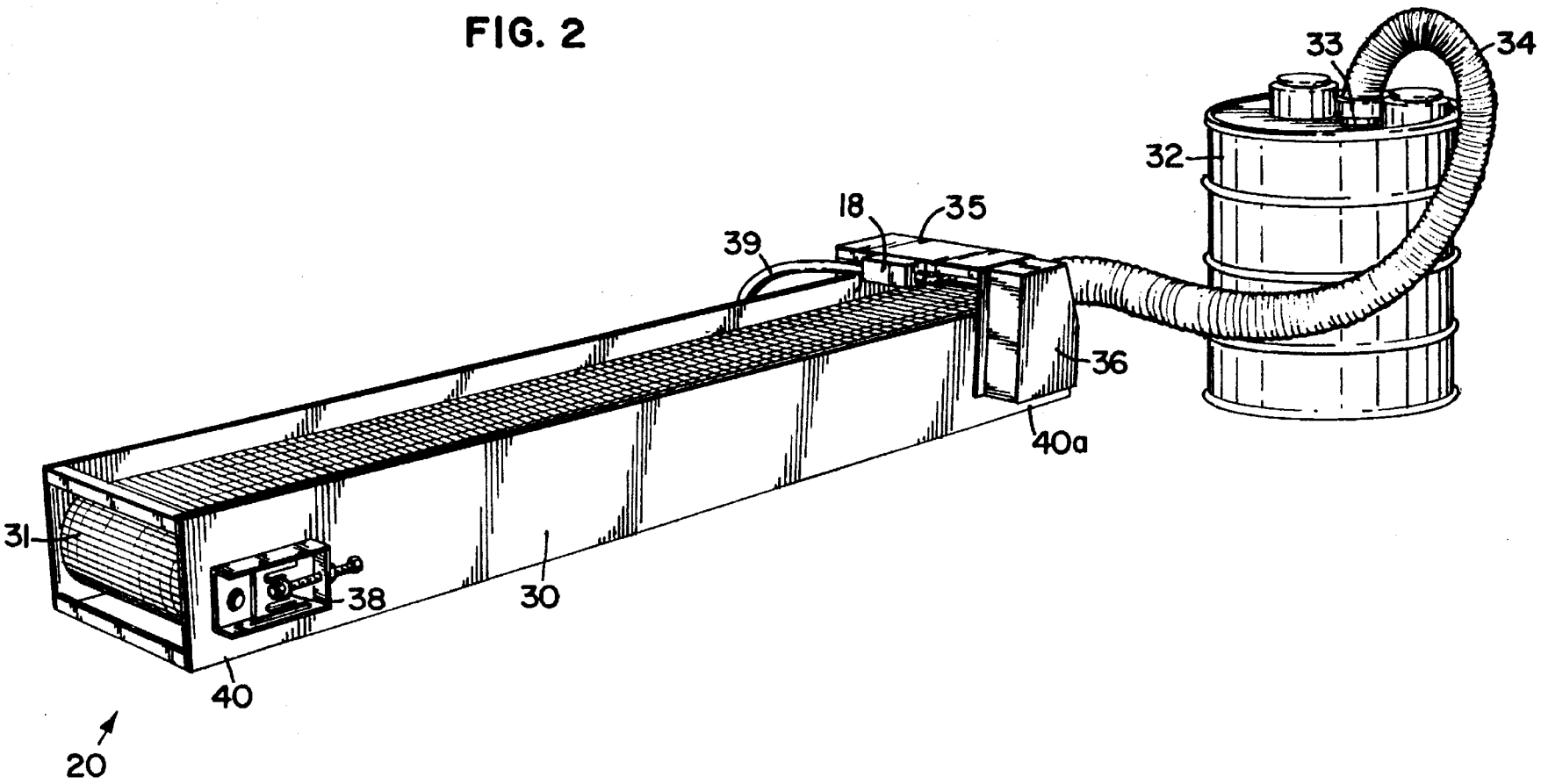
FIG. 2 is a perspective view of the preferred embodiment magnetic sweeper 20 of FIG. 1.

Turning now to FIG. 2, a perspective view of the magnetic sweeper apparatus is illustrated generally at 20. The sweeper apparatus includes a continuous ribbed belt 31 which travels about two rollers 45, 46 (best seen in FIGS. 1 and 5). The belt 31 is located in an elongated frame 30 having a first end 40 and a second end **40*a*. The frame 30 is generally comprised of two oppositely disposed elongated members with cross braces. The elongated members generally form a channel on the top of the magnetic sweeper 20, with the belt 31** residing at the bottom of the channel.

A particle collection means is cooperatively connected at the second end **40*a* to provide for retention and storage of the collected particles. The particle collection means is best seen in FIG. 5**, and includes a vacuum source, a collection flange, and a brush. Together these elements operate to remove the collected particles to a storage location comprised of a containment means. Each of the elements will be described in more detail below.

More specifically, and still referring to FIG. 2, blower motor 33 is used to create a vacuum which transports the particles from the particle collection means to the storage location 32 containment means. In the preferred embodiment, blower motor 33 may be a wet/dry type vacuum motor (which includes a filter; not shown). The blower motor 33 is properly connected to a power source located on the locomotive 25.

After a certain period of operation, the contained particles in the storage location 32 should be removed. A hose 34 is used to place the blower motor 33 in fluid communication with the particle collection means. The particles are contained so that they do not once again become airborne. Other devices which perform the foregoing functions will be readily apparent to those skilled in the art.

The storage location 32 may be a 55-gallon drum. The storage location 32 is preferably located on the locomotive 25. The storage location 32 may be located on the outside of the locomotive, or alternatively, inside the locomotive in a room **25*a* near the rear of the locomotive, for example as shown in FIG. 10. In addition, as is also shown in FIG. 10, the storage location 32 and the blower motor 33 may be sealed inside a second, weatherproofed container 142, such as a 95-gallon plastic drum having holes drilled therein for hose 34, as well as for the power cord and exhaust for motor 33** and for drainage, to protect the particle collection means from the environment.

Referring once again to FIG. 1, a front view of the magnetic sweeper 20 is provided. The belt 31, magnet 43, rollers 45, 46, drive sprockets and drive motor 42 are illustrated in phantom in order to show their orientation within the preferred magnetic sweeper 20. Arrow 50 illustrates the direction of movement of belt 31.

In operation (best seen diagrammatically in FIG. 5) the magnet 43 draws metallic particles toward it by magnetic attraction along the lines of magnetic flux. However, since the belt 31 is placed between the magnet 43 and the air currents, the particles impinge themselves on the belt 31 while not actually reaching the magnet 43. Once the particles are transported away from the magnetic field by the belt 31, the particles fall from the belt 31. Thus, the belt 31 remains clean and does not become overloaded with particles during transit of the magnetic sweeper device over the rails 22, 23.

Also illustrated in FIGS. 1 and 2 is adjustment means 38 which are provided at first end 40 of frame 30. Adjustment means 38 is used to keep the belt 31 adjusted to its proper tension. The adjustment means 38 is cooperatively connected to the axis of roller 45. Those skilled in the art will appreciate that a second adjustment means device which is a mirror image of adjustment means 38 is located on the opposite side of frame 30. Adjustment means 38 is well known in the art and in the preferred embodiment is comprised of a take-up bearing unit cooperatively connected to roller 45 (i.e., is located at the idler end of the conveyor belt).

Further illustrated in FIGS. 1 and 5 is the preferred location of brush 41 which is used to help dislodge particles which may become stuck on belt 31 during operation. Although the belt 31 is not magnetized, some particles may become "trapped" on the belt for various reasons (e.g., particles which are wet, have some other substance on them, etc.). It is preferable to remove such particles from the belt 31. Accordingly, a brush 41 having a plurality of bristles is arranged and configured in relation to the belt 31 such that the bristles contact the belt 31, as the belt 31 moves past the brush 41.

Still referring to FIG. 1, the magnetic sweeper 20 was fabricated to meet the size specifications discussed above, while capturing particles from a predetermined distance of six (6) inches. Such particles are generally of a small size (ranging from micro- to milli-inches in approximate or mean diameter). Accordingly, the momentum of the particles in the airstream can be overcome by the magnetic field strength of the magnet 43 from the predetermined distance (assuming reasonable velocities).

It will be appreciated by those skilled in the art that any other number of "predetermined distances" might be selected. In such an instance, the magnetic field strength may require adjustment to capture the desired particles. Thus, the example predetermined distance and corresponding magnetic field strength used herein should not be viewed in a limiting manner.

Magnet 43 (discussed in more detail below) is housed in a stainless steel frame 30. The preferred frame 30 is constructed using 304 stainless steel. Austenitic stainless steel was selected because it is non-magnetic and has a higher residual weld strength than other non-magnetic materials, such as aluminum.

As noted, the non-magnetic ribbed belt 31 is supported by rollers 45, 46 which are located at ends 40 and **40*a* respectively. The belt 31 is used to transport the particles from the first (attraction) station to a second (collection) station. The belt 31 is driven by contact with roller 46. A number 40 roller chain drive 51 is used to couple the drive motor 42 to the roller 46. The drive sprockets 52, 53 are best seen in FIG. 1, and are selected based upon shaft speed of the drive motor 42 and the desired speed of the belt 31**.

The drive sprockets 52, 53 and motor 42 are protected by cover 36. A power connector box 18 is connected to cable 39 which is connected to an appropriate power source in order to power motor 42. Such power sources are available on locomotive 25. Although not shown, those skilled in the art will appreciate that proper controller devices and voltage regulators may be required in order for motor 42 to operate in its intended manner. Second cover 35 is also provided to protect the motor 42 and component parts of the magnetic sweeper 20.

It may also be useful for a cut off sensor to be provided for sensing movement of the train over the railbed. The optional cut off sensor operates to shut off the magnetic sweeper 20 until movement of the train is detected, thereby adding to the service life of the apparatus.

One suitable cut off sensor 136 is illustrated schematically in FIG. 9. Sensor 136 senses the position of throttle 135 on locomotive 25, whereby when throttle 135 is moved from an "idle" position, sensor 136 provides an electrical signal to activate relay 132 and supply power from power source 130 (representing the on board power source of the locomotive) to turn on blower motor 33 and drive motor 42. Similarly, when the throttle is returned to an "idle" position, sensor 136 deactivates relay 132 to shut motors 33 and 42 off. It will be appreciated that different sensors, such as a motion sensor, may be used to detect the movement of locomotive 25 alternative to throttle position sensor 136.

Those skilled in the art will recognize that although an electric drive motor 42 is illustrated in FIG. 4, other types of motors including hydraulic drive, direct drives from the rail car wheels 24, etc. might also be utilized. The speed of the belt 31 is determined by power consumption, centrifugal force, aerodynamics and volume of particles to be collected. In the preferred embodiment the belt 31 speed is one foot per second.

FIG. 4 illustrates the bottom view of the magnetic sweeper 20. The direction of belt 31 is illustrated by arrow 50. The vacuum intake area is illustrated in phantom. Those skilled in the art will appreciate that the precise location of the vacuum inlet 96 and direction of the belt 31 are design choices.

Next referring to FIG. 5, the particle collection means is illustrated schematically in more detail. In the preferred embodiment, the particle collection means is located on the second end **40*a* (i.e., the driven end of belt 31). Particles are attracted by the magnetic field of the magnet 43 and are impinged on the belt 31 prior to reaching the magnet 43. The movement of the belt 31 transports the particles to the second end 40*a* of the magnetic sweeper 20. The second end 40*a* of the magnetic sweeper 20 comprises an area of reduced magnetic field strength. Accordingly, the particles fall from the belt and are drawn by a vacuum-created airstream into the fluid communication means 34. The particles are then transported to containment means which is comprised of storage location 32**.

The particles which remain impinged on the belt 31 are removed by the brush 41 as the belt 31 moves about the roller 46. Brush is cooperatively connected to the side walls of the frame 30 of magnetic sweeper 20. The brush 41 does not restrict the air flow since it is not located within the entrained airstream. However, particles that are removed from the belt 31 by the brush 41 fall down (designated by arrow 101), enter vacuum inlet nozzle 96, and are entrained in the airstream (designated by arrows 100) for removal and subsequent containment.

A urethane sealing gasket 99 is cooperatively connected to the side wall of the particle collection flange 98 and within the side walls of the frame 30. The sealing gasket 99 includes a free end 97 which sealingly contacts the belt 31 so as to minimize and/or prevent air flow from the top of the collection means. It will be appreciated that the free end 97 of the gasket 99 slides over the belt 31 as the belt 31 rotates. Accordingly, the gasket 99 should be arranged and configured to engage the belt, but not so tightly as to cause excessive wear.

It will be understood by those skilled in the art that magnetic devices used in connection with rail cars may have an effect on equipment located along a track. Therefore, consideration must be given to the magnet size and strength to minimize the impact on those devices. It is believed that the size and strength of the magnet used in the preferred embodiment disclosed herein will not adversely effect wayside equipment along tracks 22, 23. Further, those skilled in the art will appreciate that the location of the magnetic sweeper 20 must be constrained to certain areas in order to effectively reduce particle contamination and not effect the rail car equipment. In the preferred embodiment, the magnetic field extends approximately 6 inches away from the magnet surface. Tracks 22, 23 are approximately 4.25 inches away from the magnet surface when the magnetic sweeper 20 is in its operative position. Therefore, wayside equipment should experience negligible interference from the sweeper's magnetic field.

In operation, the magnet 43 is sized to attract airborne contaminants from 6 inches away. This sizing is due to quantitative tests which were performed on samples of contamination from the rail grinding process. The results of these tests indicated that approximately 120 Oe is required to lift a major portion of the particles from rest to the magnet surface. In the preferred embodiment, a ceramic magnet of dimensions 66 inches×12 inches×4 inches and weighing 470 lbs is used. However, those skilled in the art will realize that NeFeB magnets, electromagnets, or other types of magnets might be used in connection with the present invention.

In certain applications, it may also be desirable to include a large particle filter for hindering the magnetic sweeper from picking up larger particles which may become lodged in the sweeper. It has been found that some larger collected particles may impede the movement of the belt and/or obstruct the particle collection means.

For example, FIG. 8 shows one preferred filter design 120 mounted on magnetic sweeper 20. Filter 120 preferably covers the open bottom of frame 30, and may also cover the open sides thereof to shield workers from the moving belt in operation. Filter 120 is preferably constructed of a non-magnetic screen such as a 16 gauge perforated stainless steel sheet metal with ¼ inch holes punched on 5/16 inch centers. Filter 120 is also bent as necessary to form flanges suitable for mounting the filter on frame 30. It has been found that the ¼ inch holes in filter 120 are suitable for enabling airborne particles to pass freely through the filter and be impinged on belt 31, while preventing larger particles from passing through the filter where they could become lodged in the magnetic sweeper. It will be appreciated that various alternative materials, aperture sizes, and designs may be used to filter out large particles consistent with the invention.

Again referring to the preferred embodiment shown in FIG. 1, the majority of the weight of the magnetic sweeper 20 is made up of the weight of magnet 31. However, those skilled in the art will realize that the weight will vary depending on the supporting frame and type of magnet employed.

Alternative Embodiments

FIGS. *6a* and *6b* show alternative embodiments utilizing a magnetic belt 110 running beneath a non-magnetic belt 111. A portion of the non-magnetic belt 111 extends beyond the magnetic belt 110 and provides an opportunity for the particles which are impinged on the non-magnetic belt 111 to be dislodged either by gravity, scraper or vacuum means into containment area 32'.

FIGS. *7a* and *7b* illustrate additional alternative embodiments utilizing magnetic drums 112 for attracting the airborne particles. The particles can be dislodged by a scraper 113 or other device into the collection area 114. In order to further contain the particles, collection area 114 may be include a magnetic lining 115.

The alternative embodiment sweepers may be located beneath a rail car or located as "stand-alone" units on wheels 116.

The magnetic sweeper 20 is also thought to be extremely useful when used in combination with magnetic skirts which are fitted to or beneath the deck 83 of rail car 75. The magnetic skirts attract particles directly and may be periodically washed/cleaned to remove the attracted particles. In addition to attracting particles, the skirts (not shown) may be arranged and configured to alter the air currents around the rail car 75 to further minimize particle infiltration. An example of one such skirt is illustrated in U.S. Pat. No. 5,307,744 issued to Newman et al., which is assigned to one of the assignees of the present application, and which is incorporated herein by reference.

It is to be understood that even though numerous characteristics and advantages of the present invention have been set forth in the foregoing description, together with details of the structure and function of the invention, the disclosure is illustrative only and changes may be made in detail, especially in matters of the location of the sweeper, in the manner of means of driving the belt, etc. Therefore, it will be appreciated by those skilled in the art that other configurations that embody the principles of this invention and other applications therefor (other than as described herein) can be configured within the spirit and intent of this invention. The embodiments described herein are provided as examples of an embodiment that incorporates and practices the principles of this invention. Other modifications and alterations are within the knowledge of those skilled in the art and are to be included within the broad scope of the appended claims.

What is claimed is:

1. A magnetic particle sweeper apparatus for railroad beds, of the type which collects airborne particles exhibiting ferromagnetic behavior, comprising:

(a) a support frame;

(b) first and second rollers located at opposite ends of said frame;

(c) a continuous driven belt passing over said first and second rollers;

(d) magnetic means operatively connected to said frame and located within said belt, wherein airborne particles are attracted to said magnetic means and are impinged on said belt; and (e) particle collection means, cooperatively connected to said second end of said frame, for collecting the particles to minimize allowing the impinged particles from becoming airborne, wherein subsequent to the particles being transported along a portion of said belt and away from said magnetic means said collection means transports the particles to a remote location, and wherein said particle collection means includes:

(i) a particle flange which is arranged and configured at said second end of said frame; and (ii) a vacuum source operatively inserted through said particle flange and which tends to draw the particles from said second end.

2. The apparatus of claim 1, wherein said magnetic means are a permanent ceramic magnet.

3. The apparatus of claim 1, wherein said magnetic means includes a second belt which is magnetic.

4. The apparatus of claim 1, wherein said collection means transports the particles to a containment means.

5. The apparatus of claim 1, wherein said collection means further comprises a brush in operative contact with said belt for removing particles from said belt which do not release from said belt by gravity once the particles are outside of the magnetic field of said magnet means.

6. The apparatus of claim 1, wherein said belt is non-magnetic.

7. The apparatus of claim 1, further comprising an electrically-powered motor for driving said belt.

8. The apparatus of claim 1, further comprising adjustment means, cooperatively connected to said first roller, for adjusting the tension of said belt.

9. The apparatus of claim 8, wherein said belt adjustment means comprises a bearing take-up unit.

10. The apparatus of claim 1, wherein said support frame is constructed of a non-magnetic material.

11. A magnetic sweeper apparatus for use on a railroad car for collecting airborne metallic particles and grit from a railroad bed, comprising:

(a) a supporting frame structure which can be attached to an underside of the railroad car, wherein at least one side of said supporting frame structure forms a channel having two oppositely disposed side walls and a bottom;

(b) a source of magnetic attraction operatively attached to said supporting frame structure, the area of magnetic attraction defining a first location;

(c) a prime mover operatively attached to said supporting frame structure;

(d) a non-magnetic endless belt driven by said prime mover, said belt arranged and configured with said supporting frame member so as to nearly completely encompass said source of magnetic attraction, and to extend outside of said source of magnetic attraction in at least a second location, wherein said belt is located at the bottom of said channel; and (e) particle collection means, operatively connected to said supporting frame member at said second location, wherein said particle collection means includes:

(i) a particle flange which is arranged and configured at said second end of said frame;

(ii) a vacuum source operatively inserted through said particle flange and which tends to draw the particles from said second end at an inlet nozzle;

(iii) a brush in operative contact with said belt for removing particles from said belt which do not release from said belt by gravity once the particles are outside of the magnetic field of said magnet source, and (iv) a sealing gasket hingedly attached at a first end to said particle flange and arranged and configured to fit within said side walls of said channel, wherein said sealing gasket includes a second end which slidingly engages said belt, and wherein a seal is created at said one side of said supporting frame, whereby air flow is directed to said inlet nozzle from proximate said second location, wherein airborne particles are attracted to said source of magnetic attraction at said first location of said belt and are transported to said second location where the particles are collected by said particle collection means to minimize the particles which are airborne, and wherein said source of magnetic attraction attracts and collects particles and grit exhibiting ferromagnetic behavior which are raised from the railroad bed during travel of the railroad car thereby protecting transported products.

12. The apparatus of claim 11, wherein said supporting frame structure is made from non-magnetic steel.

13. The apparatus of claim 11, wherein said magnetic source is a permanent magnetic material or an electromagnet.

14. Combination comprising:

(a) a railroad car having a coupler device;

(b) at least one magnetic sweeper device attached to said coupler device, said magnetic sweeper device including:

i) a support frame comprising two oppositely disposed elongated members with cross braces, wherein said elongated members are oriented transversely with respect to the longitudinal axis of the direction of travel of said railroad car;

ii) a first and second roller member located at opposite ends of said frame;

iii) a continuous driven belt passing over said first and second rollers;

iv) magnetic means operatively connected to said frame and located within said belt, wherein particles are attracted to said magnetic means and are impinged on said belt;

v) particle collection means, cooperatively connected to said second end of said frame, for collecting said particles to minimize allowing the impinged particles from becoming airborne, wherein subsequent to the particles being transported along the length of said belt and away from said magnetic means, said collection means transports the particles to a remote location.

15. A method of attracting and collecting airborne metallic particles and grit from a railroad bed during travel of a railroad car, comprising the steps of:

(a) driving a continuous belt over rollers within a support frame;

(b) orienting the longitudinal axis of said belt generally perpendicular to the longitudinal axis of the rails;

(c) attracting airborne particles which are lifted from a railroad bed by the aerodynamic action of a passing railroad car, with magnetic means operatively connected to said frame and located within said belt, whereby particles are attracted to said magnetic means and are impinged on said belt; and (d) collecting said particles to minimize allowing the impinged particles from becoming airborne, wherein subsequent to the particles being transported along the length of said belt and away from said magnetic means, said collection means transports the particles to a remote location.

16. The method of claim 15, further comprising the step of locating said belt beneath the coupler of a locomotive.

17. A magnetic particle sweeper apparatus for collecting airborne particles exhibiting ferromagnetic behavior from a railroad bed during transportation of a railroad car, comprising:

(a) a support frame adapted for mounting on a railroad car;

(b) first and second rollers located at opposite ends of said frame;

(c) a continuous driven belt passing over said first and second rollers and having a longitudinal axis oriented generally transverse to a direction of travel of the railroad car;

(d) magnetic means operatively connected to said frame and located within said belt, wherein airborne particles are attracted to said magnetic means and are impinged on said belt; and (e) particle collection means, cooperatively connected to said second end of said frame, for collecting said particles to minimize allowing the impinged particles from becoming airborne, wherein subsequent to the particles being transported along a portion of said belt and away from said magnetic means said collection means transports the particles to a remote location.

18. A magnetic particle sweeper apparatus for railroad beds, of the type which collect airborne particles exhibiting ferromagnetic behavior, comprising:

(a) a support frame;

(b) first and second rollers located at opposite ends of said frame;

(c) a continuous driven belt passing over said first and second rollers;

(d) magnetic means operatively connected to said frame and located within said belt, wherein airborne particles are attracted to said magnetic means and are impinged on said belt;

(e) particle collection means, cooperatively connected to said second end of said frame, for collecting said particles to minimize allowing the impinged particles from becoming airborne, wherein subsequent to the particles being transported along a portion of said belt and away from said magnetic means said collection means transports the particles to a remote location; and (f) large particle filtering means, coupled to said frame, for preventing particles larger than a predetermined size from impinging on said belt.

19. The apparatus of claim 18, wherein said frame includes an open bottom, and wherein said large particle filtering means comprises a non-magnetic perforated sheet mounted to said frame and covering the open bottom thereof.

20. The apparatus of claim 19, wherein said perforated sheet includes about ¼ inch diameter perforations arranged along about 5/16 inch centers.

21. The apparatus of claim 19, wherein said frame includes open ends, and wherein said perforated sheet further covers the open ends of said frame.

22. A railroad locomotive, comprising:

(a) a coupler device;

(b) at least one magnetic sweeper device attached to said coupler device for capturing airborne magnetic particles, said magnetic sweeper device including:

i) a support frame comprising (two oppositely disposed elongated members joined by cross braces and oriented transversely with respect to the longitudinal axis of the direction of travel of said locomotive;)

ii) first and second roller members located at opposite ends of said frame;

iii) a continuous driven belt passing over said first and second rollers;

iv) magnetic means operatively connected to said frame and located within said belt, wherein particles are attracted to said magnetic means and are impinged on said belt; and v) particle collection means, cooperatively connected to said second end of said frame, for collecting said particles to minimize allowing the impinged particles from becoming airborne, wherein subsequent to the particles being transported along the length of said belt and away from said magnetic means, said collection means transports the particles to a remote location.

23. The locomotive of claim 22, wherein said particle collection means includes a vacuum and a storage container cooperatively connected to said second end of said frame through a hose, and wherein said vacuum source and said storage container are housed inside said locomotive.

24. The locomotive of claim 23, wherein said vacuum source and said storage container are housed within a weatherproofed container inside said locomotive.

25. The locomotive of claim 22, further comprising cut off means for shutting off said magnetic sweeper device when said locomotive is not moving.

26. The locomotive of claim 25, wherein said cut off means comprises a throttle position sensor coupled to a throttle on said locomotive to sense when said throttle is in an idle position.

* * * * *